US006054971A

United States Patent [19]

Okada et al.

[11] Patent Number: 6,054,971

[45] Date of Patent: Apr. 25, 2000

[54] DISPLAY APPARATUS

[75] Inventors: Shinjiro Okada, Isehara; Yutaka Inaba, Kawaguchi, both of Japan

[73] Assignee: Canon Kabushiki Kaisha, Tokyo, Japan

[21] Appl. No.: 08/241,680

[22] Filed: May 12, 1994

Related U.S. Application Data

[63] Continuation of application No. 07/836,801, Feb. 19, 1992, abandoned.

[30] Foreign Application Priority Data

Feb. 20, 1991 [JP] Japan ..... 3-045624

[51] Int. Cl.[7] ..... G09G 3/18

[52] U.S. Cl. ..... 345/89; 345/63; 345/147

[58] Field of Search ..... 345/87, 89, 90, 345/97, 98, 185, 63, 147; 359/54, 87, 62; 349/33

[56] References Cited

U.S. PATENT DOCUMENTS

| | | | |
|---|---|---|---|
| 4,531,160 | 7/1985 | Ehn | 340/793 |
| 4,639,089 | 1/1987 | Okada et al. | 350/341 |
| 4,655,561 | 4/1987 | Kanbe et al. | 350/350 S |
| 4,681,404 | 7/1987 | Okada et al. | 350/350 S |
| 4,709,995 | 12/1987 | Kuribayashi et al. | 350/350 S |
| 4,712,877 | 12/1987 | Okada et al. | 350/350 S |
| 4,738,515 | 4/1988 | Okada et al. | 350/350 S |
| 4,763,994 | 8/1988 | Kaneko et al. | 350/336 |
| 4,763,995 | 8/1988 | Katagiri et al. | 350/341 |
| 4,765,720 | 8/1988 | Toyono et al. | 350/350 S |
| 4,776,676 | 10/1988 | Inoue et al. | 345/97 |
| 4,824,218 | 4/1989 | Kuno et al. | 350/350 S |
| 4,864,290 | 9/1989 | Waters | 340/793 |
| 4,941,736 | 7/1990 | Taniguchi et al. | 359/56 |
| 5,013,141 | 5/1991 | Sakata | 359/87 |
| 5,066,945 | 11/1991 | Kanno et al. | 340/784 |
| 5,225,821 | 7/1993 | Soto | 345/97 |
| 5,347,294 | 9/1994 | Usui et al. | 345/85 |
| 5,359,344 | 10/1994 | Inoue et al. | 345/98 |
| 5,396,352 | 3/1995 | Kaneko et al. | 345/97 |

FOREIGN PATENT DOCUMENTS

| | | | |
|---|---|---|---|
| 0261900 | 3/1988 | European Pat. Off. . | |
| 0217893 | 8/1990 | Japan | 340/784 |
| 2113477 | 9/1991 | Japan | 345/89 |
| 2134300 | 8/1984 | United Kingdom | 340/784 |

*Primary Examiner*—Lun-Yi Lao

*Attorney, Agent, or Firm*—Fitzpatrick, Cella, Harper & Scinto

[57] ABSTRACT

A ferroelectric liquid crystal apparatus comprising a liquid crystal cell having a ferroelectric liquid crystal carried between electrode substrates, means for producing a voltage signal for writing the information by applying an electric field via the electrode substrate and driving the ferroelectric liquid crystal, wherein voltage signal producing means determines the voltage signal value with reference to the drive status of a ferroelectric liquid crystal before writing, in writing the information.

2 Claims, 5 Drawing Sheets

IMAGE INFORMATION
101
G
A/D CONVERTER
103
Qn
CONTROLLER
105
WRITE
VRAM Q^n-1
READ
Q^n-1
Qn
COM S/R
111
DECODER
113
ANALOG SW
115
F L C
124
ANALOG SW
121
DECODER
119
SEG S/R
117
COMPARISON OPERATION COMPARATER
107
INFORMATION SIGNAL VOLTAGE CONTROL <Table>
109

| STATUS COMPARISON RESULT | DOMAIN CHANGE (Example) | CONCERNED THRESHOLD CURVE |
|---|---|---|
| Q(n) > Q(n−1) |  | Vb |
| Q(n−1) < Q(n) | | Vw |
| Q(n−1) = Q(n) | | Vw |

DISPLAY APPARATUS

This application is a continuation of application Ser. No. 07/836,801 filed Feb. 19, 1992, now abandoned.

BACKGROUND OF THE INVENTION

1. Field of the Invention

The present invention relates to an element and a display apparatus using a chiral smectic liquid crystal exhibiting the ferroelectricity.

2. Related Background Art

Display apparatuses using ferroelectric chiral smectic liquid crystals (thereinafter referred to as FLC) have been well known in which liquid crystal cell is constituted of two glass substrates opposed in a cell gap of about 1 micron to 3 micron, the inner face of glass substrate being formed with transparent electrode and treated for the orientation, and the ferroelectric chiral smectic liquid crystal is injected into the liquid crystal cell, as described in, for example, U.S. Pat. No. 4,639,089, U.S. Pat. No. 4,681,404, U.S. Pat. No. 4,682,858, U.S. Pat. No. 4,712,873, U.S. Pat. No. 4,712,874, U.S. Pat. No. 4,712,875, U.S. Pat. No. 4,712,877, U.S. Pat. No. 4,714,323, U.S. Pat. No. 4,728,176, U.S. Pat. No. 4,738,515, U.S. Pat. No. 4,740,060, U.S. Pat. No. 4,765,720, U.S. Pat. No. 4,778,259, U.S. Pat. No. 4,796,979, U.S. Pat. No. 4,796,980, U.S. Pat. No. 4,859,036, U.S. Pat. No. 4,932,757, U.S. Pat. No. 4,932,758, U.S. Pat. No. 5,000,545, and U.S. Pat. No. 5,007,716.

This FLC brought about a problem because the drive characteristics might be varied in the write frame scanning, depending on the display status of one screen with the write frame scanning already completed, particularly when the gradation is represented.

SUMMARY OF THE INVENTION

An object of the invention is to resolve the above-mentioned problem and to provide a display apparatus particularly suitable for the gradation display.

The present invention provides a display apparatus comprising, a) a liquid crystal panel having a matrix electrode constituted of a scan electrode and an information electrode crossed with a gap, and a liquid crystal disposed between the scan electrode and the information electrode, b) driving means for outputting a drive pulse to the matrix electrode so as to sequentially scan the scan electrode, and apply a pulse in accordance with the image information to the information electrode, in synctronism with a scan pulse, and c) control means having receiving means for receiving the image information to be serially transferred, memory means for the memory of the received image information within a first period to output the image information in memory within the first period, and comparing means for comparing the image information within the first period output from the memory means and that within a second period next to the first period, for controlling the driving means so that the drive pulse output from the driving means to the liquid crystal panel is controlled in accordance with the information from the comparing means.

DETAILED DESCRIPTION OF THE PREFERRED EMBODIMENTS

Figure 4A:
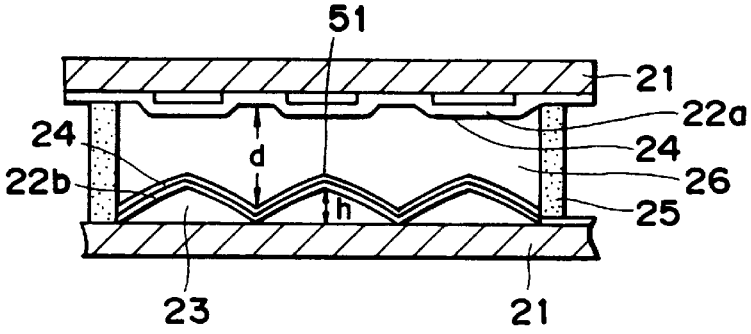
FIG. 4A is a cross-sectional view illustrating a cell provided with angular ridges within a pixel for use with an apparatus of FIG. 1.
Figure 5B:
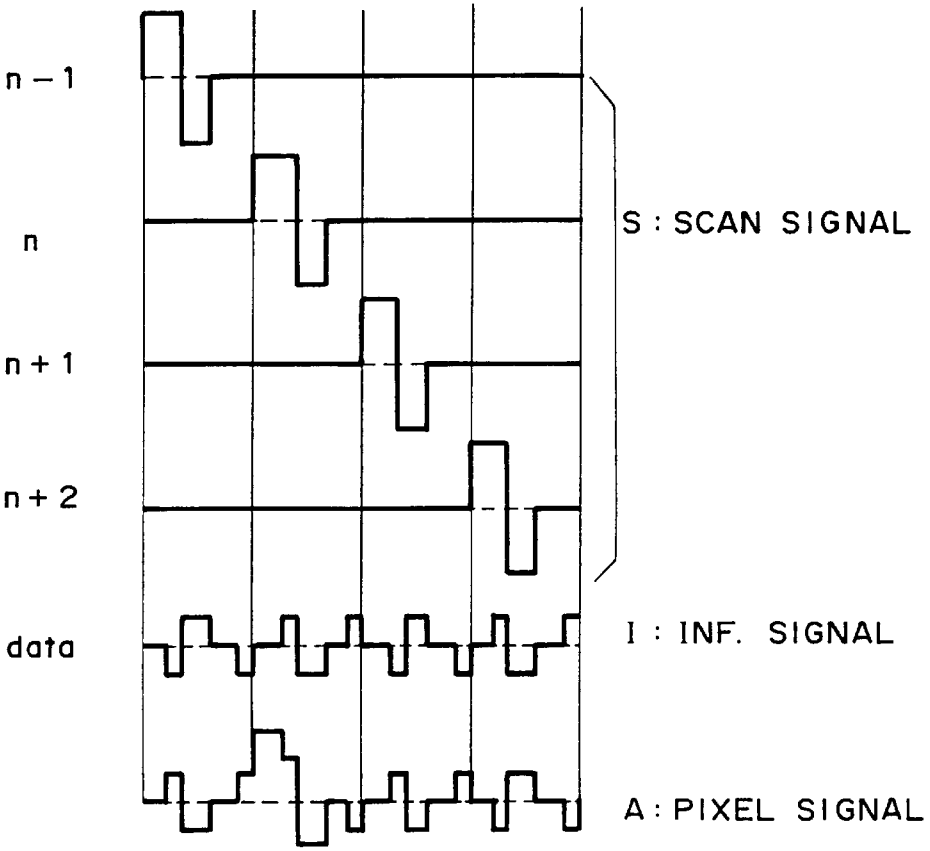
FIGS. 5A and 5B are waveform diagrams of the driving voltage for use with the apparatus of FIG. 1.
Figure 5A:
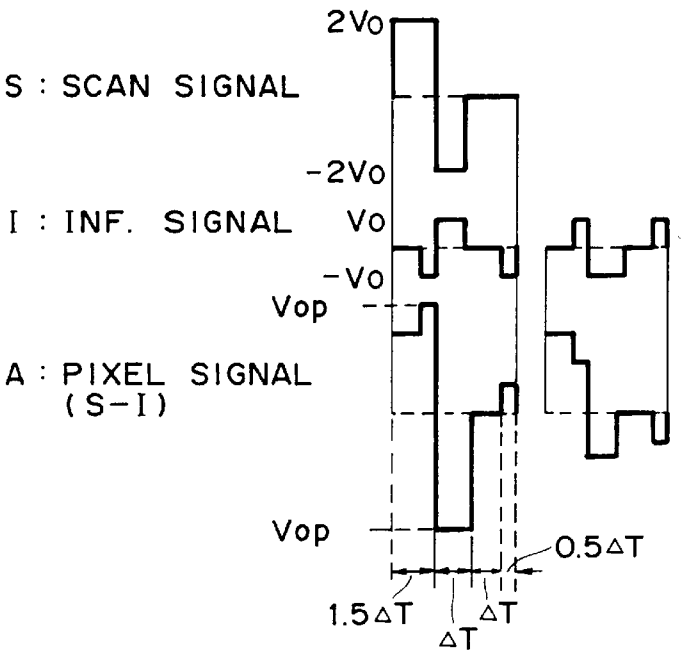

According to the experiments of the inventors, supposing that the intersection of matrix electrode is a pixel, FLC has different thresholds, when a certain pixel is written, depending on the status in which the pixel is presently written. Specifically, when the voltage waveform such as the pixel signal A having the scan signal S and the information signal I as shown in FIG. 5 is applied to a matrix cell provided with angular ridges 51 within the pixel, as typically shown in FIG. 4A, measurement results were obtained in which the threshold curve in writing the white with the erasion of black when the pixel is white is a curve Vw in FIG. 2, while that in writing white status with the erasion of black for the pixel in black status is a curve Vb in FIG. 2. Between the curves Vw and Vb, there is a deviation of about 0.4 to 1.0 volts. Note that $|V0|=22$ volts, and the width of pulse $\Delta T=40$ $\mu$s were used. The measuring temperature was 28° C. The cell in use had a cell thickness of about 1.2 $\mu$m, with the height h of the ridge 51 being 0.5 $\mu$m, and the oriented film 24 was polyimide containing fluorine.

Figure 2:
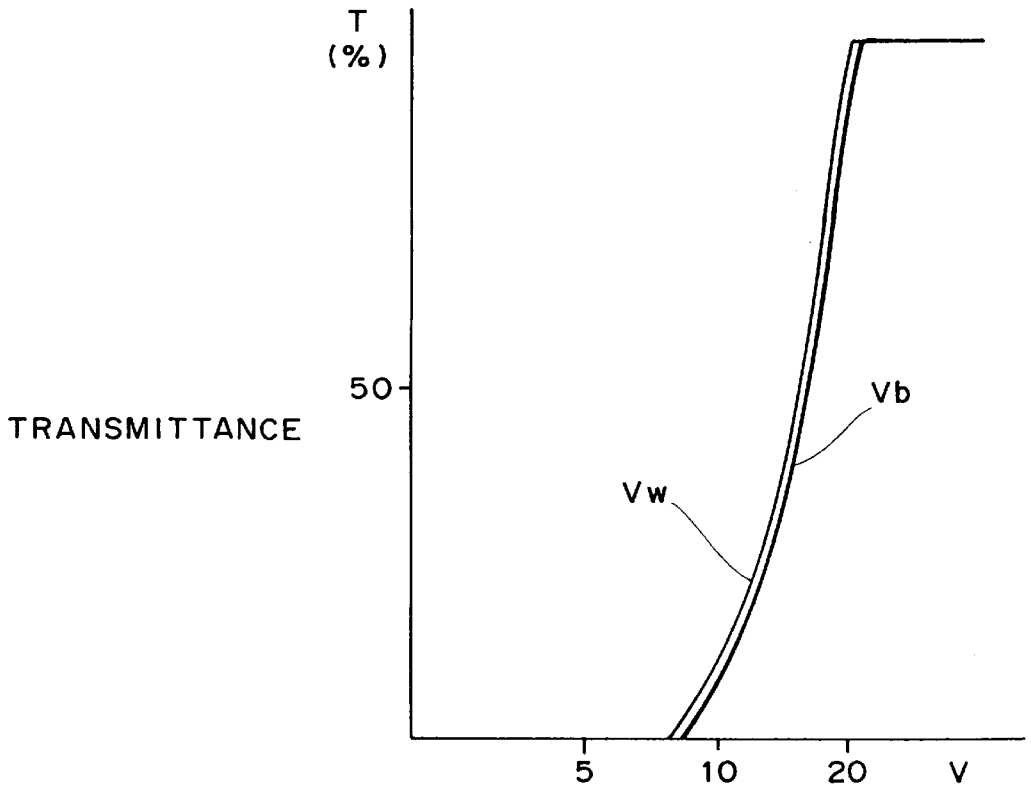
FIG. 2 is a graph showing a threshold curve, with a waveform diagram of a signal for use with the measurement thereof.
Figure 3:
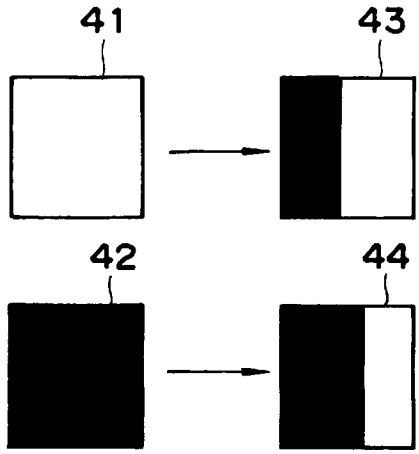
FIG. 3 is a typical view illustrating the writing of image subjected to the influence of the hysteresis.

In this way, the FLC element has the hysteresis characteristics as represented by FIG. 2, thereby causing a problem particularly for the gradation display. That is, as shown in FIG. 3, when the gradation informations are written with the same waveform for a white pixel 41 and a black pixel 42, respectively, different gradation levels will be written, as shown by the pixels 43 and 44, respectively. Note that different threshold values are distributed within each pixel of FIG. 3, the threshold being lowest at the right end, and highest at the left end. That is, the gradation display is made corresponding to the slant face of ridge shape in the cell of FIG. 4. When the binary representation of "white" and "black" is simply made, such a hysteresis phenomenon can be avoided by making the applied voltage too large or too small, but with the gradation display, the problem arises because the excessive voltage applying method can not be used.

Figure 4B:
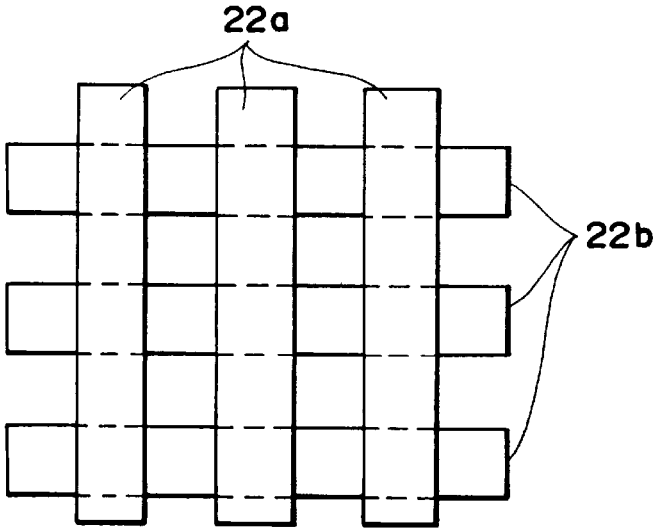
FIG. 4B is a plan view of the cell as illustrated in FIG. 4A.

Such a hysteresis phenomenon also occurs with the cell formed of the scan electrode 22*a* and the information electrode 22*b* in a simple matrix method, as shown in FIG. 4, but with an active matrix method, the problem is further serious. In the active matrix method, the voltage applied to the pixel is floating for most of the time. For example, for cell is scanned in such a manner as to turn on the gate for 10 $\mu$s to put the cell in the floating state for 30 ms, and then write it again. In this floating state, the reverse electric field formed by the spontaneous polarization Ps of the FLC has a larger influence than in the simple matrix of short mode. The experiment indicated that when the same cell as shown in FIG. 4 is used, a difference between hystereses of the threshold curve in writing white and black is about 4V, amounting to about ten times that with the simple matrix.

With the present invention, in one pixel, a deviation (hysteresis) may occur in the value of applied voltage for correctly displaying the content of the information to be written presently, depending on a drive status (display status) of the pixel before writing. However, since the value of a voltage signal is determined with reference to the drive status of ferroelectric liquid crystal before writing, such a deviation can be corrected, so that the voltage signal having an optimal value for correctly displaying the content of the information can be always created.

Figure 1:
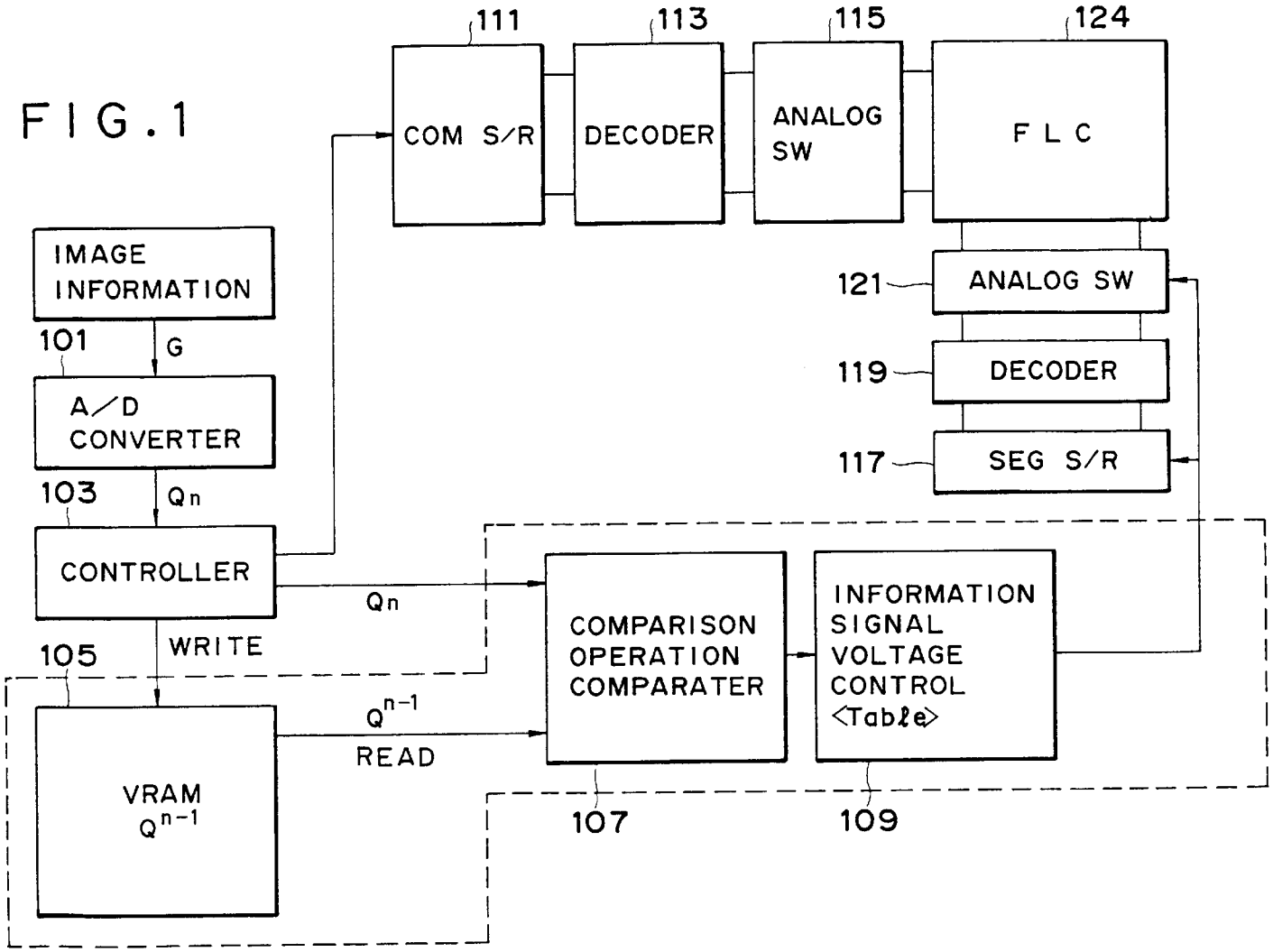
FIG. 1 is a block diagram illustrating a ferroelectric liquid crystal element in one example of the present invention.

FIG. 1 is a block diagram showing a ferroelectric liquid crystal element in one example of the present invention. A part surrounded by the broken line in the figure is an improvement in the present invention. In the figure, 101 is an A/D converter for converting the analog image signal to the digital signal Q, 103 is a controller for outputting the image information Q from the A/D converter 101 to each portion, 105 is a VRAM for storing the image information Q from the controller 103, 107 is a comparator for comparing the current image information Q(n) from the controller 103 with the previous image information Q(n−1) stored in VRAM 105 to output its result, 109 is an information signal voltage control circuit for determining the voltage of an information signal based on the output of the comparator 107, 111 is a common S/R connected to the controller 103, 113 is a decoder connected to the common S/R 111, 115 is an analog switch connected to the decoder 113, 117 is a segment S/R connected to the information signal voltage control circuit 109, 119 is a decoder connected to the segment S/R 117, 121 is an analog switch connected to the decoder 119, and 124 is a liquid crystal cell having an FLC capable to the gradation display, to which the scan signal and the information signal are applied via the analog switches 115 and 121. FIG. 4 is a cross-sectional view of the liquid crystal cell 124 as shown in FIG. 1. In the figure, 21 is a glass substrate, 22*a*, 22*b* are stripe electrodes of ITO formed on the glass substrate 21, 24 is an oriented film of polyimide containing fluorine formed on the stripe electrode 22, 25 is a sealing member, 26 is an FLC sealed into the cell by the sealing member 25, and 23 is a ridge forming member made of acrylic UV cured resin. The FLC 26 has a spontaneous polarization Ps, a tilt angle θ and Δε at each temperature, as shown in Table 1, and shows the phase transition as in formula 1.

TABLE 1

| Temperature | 10 | 28 | 40 |
|---|---|---|---|
| Ps[nc/cm$^2$] | 8.4 | 6.6 | 5.1 |
| θ [°] | — | ~22 | — |
| Δε | — | −0.1 | — |

Formula 1

$$\text{Iso} \xrightarrow{88.4} \text{ch} \xrightarrow{71.2} \text{SmA} \xrightarrow{58.5} \text{Smc*} \xrightarrow{-23.5[^\circ\text{C}]} \text{Cryst}$$

$$\xleftarrow{84.9} \quad \xleftarrow{72.6} \quad \xleftarrow{59.4} \quad \xleftarrow{-18.1[^\circ\text{C.}]}$$

FIG. 5 illustrates the scan signal S and the information signal I which are driving waveforms to be supplied to the liquid crystal cell 124, and the image signal A synthesized of them. The upper and lower oriented films 24 have the rubbings applied in parallel to each other.

With this constitution, if an analog image signal G containing the gradation information is input into the A/D converter 101, its signal is A/D converted to be entered via the controller 103 into the comparator 107 as the current image information Q(n), while the previous image information Q(n−1) from the VRAM 105 is entered into the comparator 107. In the comparator 107, the contents of these informations Q(n) and Q(n−1) are compared. In making this comparison, when the 8-bit information per one pixel is stored in the VRAM 105 (256 gradation display), the serial comparison is carried out in such a manner that if the highest digit of the current information Q(n) is m, the comparison with the previous information Q(n−1) is started at the m-th digit, passing to further upper digit, in which if there is a "high" upward from the m-th digit, Q(n−1)>Q(n) is judged, and if there is no "high" in the upper digit from the m-th digit, Q(n−1)<Q(n) is judged, and further, if Q(n−1) is high at the m-th digit, or the highest digit of Q(n−1) coincides with that of Q(n), the comparison from the highest digit m of Q(n) to the lower digit is made. For the comparison of the information with such comparator 107, the A/D conversion is made such that all white is the highest value (11111111), and all black is the lowest value (00000000).

Figure 6:
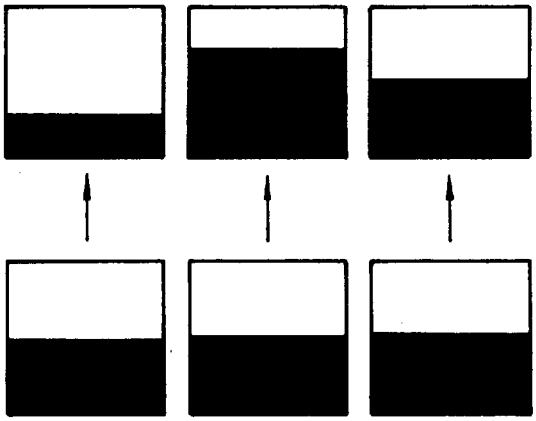
FIG. 6 is a view illustrating the relation between the domain change and the concerned threshold curve.

As shown in FIG. 6, as a result of the comparison, if Q(n)>Q(n−1), the state of Q(n) is brighter than that of Q(n−1), so that the white is written in the black portion, while if Q(n)<Q(n−1), the state of Q(n) is darker than that of Q(n−1), so that the black is written in the white portion. If Q(n)=Q(n−1), there is no change of write value. As shown in FIG. 6, the voltage of an information signal is determined by selecting either of the threshold curve Vb in which the previous status is black, and Vw in which it is white, correspondingly to respective cases. That is, Vb is selected if Q(n)>Q(n−1), and Vw is selected if Q(n)<Q(n−1) or Q(n)=Q(n−1). After the information signal voltage is determined in this way, a drive signal may be applied to the common and segment sides via a shift register.

As described above, the gist of the present invention resides in the operation of determining the information signal voltage with the comparison between the status before writing and the status to be written, but the hysteresis of FLC occurs only when the status before writing is retained for a certain period. This period is greatly different depending on the cell constitution, such as 10 to 800 ms, even when a liquid crystal having the spontaneous polarization Pa, the tilt angle θ and Δε at each temperature, as shown in Table 1, and showing the phase transition as in formula 1 is used. Accordingly, in the refresh operation, when the refresh interval is equal to or lower than the above-mentioned period, the influence of the hysteresis can not be removed only by the comparison circuit of the present invention. In such a case, it is necessary to take into consideration the further previous state Q(n−2) for the comparison. If the contents as shown in Table 1 are determined experimentally, the information can be written by correcting for the influence of hysteresis.

With the present invention, in addition to the previously described method, the gradation display method as disclosed in U.S. Pat. No. 4,655,561, U.S. Pat. No. 4,709,995, U.S. Pat. No. 4,712,877, U.S. Pat. No. 4,747,671, U.S. Pat. No. 4,763,994, U.S. Pat. No. 4,765,720, U.S. Pat. No. 4,776,676, U.S. Pat. No. 4,796,980, U.S. Pat. No. 4,818,078 and U.S. Pat. No. 4,824,218 can be applied, and the power source circuit as disclosed in U.S. Pat. No. 5,066,945 can be used.

Since the value of the voltage signal is determined with reference to the drive status before writing, as above described, it is possible to correct for the influence of the hysteresis phenomenon, and display the content of information correctly at any time.

What is claimed is:

1. A ferroelectric liquid crystal display apparatus comprising:

an active matrix liquid crystal cell comprising electrode substrates and a ferroelectric liquid crystal sandwiched therebetween; and voltage signal producing means for applying an electric field to said ferroelectric liquid crystal for driving said ferroelectric liquid crystal and for writing information thereon, wherein pixels constituting said liquid crystal cell are supplied with a writing voltage after a reset and perform gradation displaying according to the writing voltage, and in writing gradation information, said voltage signal producing means determines a current value of the writing voltage with reference to a voltage-transmittance characteristic of the liquid crystal according to previous gradation image information.

2. A ferroelectric liquid crystal display apparatus according to claim 1, wherein said voltage signal producing means has a memory for storing the previous gradation image information, and a comparator for comparing the previous gradation image information stored in said memory with current image information to be written at present.

* * * * *

UNITED STATES PATENT AND TRADEMARK OFFICE

CERTIFICATE OF CORRECTION

PATENT NO. : 6,054,971

DATED : April 25, 2000

INVENTOR(S) : SHINJIRO OKADA ET AL.

It is certified that error appears in the above-identified patent and that said Letters Patent is hereby corrected as shown below:

ON THE COVER PAGE:

In Column [56] References Cited, under FOREIGN PATENT DOCUMENTS:

"2113477" should read --2-113477--; and
"0217893" should read --2-217893--.

COLUMN 1

Line 14, "which" should read --which a--; and
Line 50, "synctronism" should read --synchronism--.

COLUMN 3

Line 31, "to the" should read --of--.

UNITED STATES PATENT AND TRADEMARK OFFICE

CERTIFICATE OF CORRECTION

PATENT NO. : 6,054,971

DATED : April 25, 2000

INVENTOR(S) : SHINJIRO OKADA ET AL.

It is certified that error appears in the above-identified patent and that said Letters Patent is hereby corrected as shown below:

COLUMN 4

Line 4, "these" should be deleted; and
Line 5, "informations" should be deleted.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*